United States Patent [19]

Burk et al.

[11] 4,032,334

[45] June 28, 1977

[54] TAPPET METALLURGY

[75] Inventors: Wayne E. Burk, La Grange; William B. Hamilton, Batavia, both of Ill.

[73] Assignee: Stanadyne, Inc., Windsor, Conn.

[22] Filed: May 10, 1976

[21] Appl. No.: 685,091

[52] U.S. Cl. ..... 75/128 C; 75/123 CB; 75/125; 75/128 D; 75/128 V; 75/128 W; 148/35; 148/39

[51] Int. Cl.[2] ..... C22C 38/07

[58] Field of Search ..... 75/128 DC, 128 V, 128 W, 75/123 CB; 148/35, 39; 45/125

[56] References Cited

UNITED STATES PATENTS

| | | | |
|---|---|---|---|
| 3,370,941 | 2/1968 | Kueny | 148/35 X |
| 3,384,515 | 5/1968 | Ackerman | 148/35 X |
| 3,411,957 | 11/1968 | Takai | 75/128 C X |
| 3,600,238 | 8/1971 | Ravenel | 148/35 X |

OTHER PUBLICATIONS

"Grey Iron Castings", Central Founding, 1971, Poll.

"Physical and Engineering Properties of Cast Iron," Angus, 1960, p. 428.

"Constituent Elements in Steel and Cast Iron," Shieldelby Corporation, Jan. 1944, pp. 75–76.

*Primary Examiner*—Arthur J. Steiner

*Attorney, Agent, or Firm*—Kinzer, Plyer, Dorn & McEachran

[57] ABSTRACT

An engine tappet has a specific composition of alloyed heat treated chilled iron to maintain the highest amount of carbides after thermal treatment to harden the matrix.

4 Claims, No Drawings

TAPPET METALLURGY

SUMMARY OF THE INVENTION

The present invention relates to tappet metallurgy and in particular to a specific metallurgical composition which will permit chilled cast iron to form a high percentage of metallic carbides in the chilled area.

Another purpose is to develop tappet metallurgy enabling a chilled cast iron to maintain the highest amount of metallic carbides in the chilled area after thermal treatment.

Another purpose is a tappet metallurgy including a chilled cast iron which has sufficient alloying elements so that the metal surrounding the carbides may be satisfactorily hardened by heat treatment.

Another purpose is to develop tappet metallurgy enabling the tappet to be readily machined.

Another purpose is to develop metallurgy which is satisfactory for use in connection with large sections or large articles, but is not limited thereto.

Other purposes will appear in the ensuing specification and claims.

DESCRIPTION OF THE PREFERRED EMBODIMENT

The present invention relates to tappet metallurgy of the type generally described in U.S. Pat. No. 3,370,941. Although the metallurgy will be described in connection with an engine tappet, it may be used for other valve train components. For example: camshafts, or other parts where wear resistance is required. It should be understood that the entire structure will be poured from the same molten material, but that only the wearing surface will have the described properties due to the use of chill apparatus, such as chill plates or chill blocks.

The tappet metallurgy described provides greater carbide structure and thus greater wear resistance on the wear surface or camface of the tappet. Conventionally, tappets, camshafts and the like have been formed of chilled iron or hardenable iron. It has been determined that a chilled cast iron is capable of providing substantially greater amounts of carbides adjacent the camface or the area adjacent to the chill plate, upon which the tappet is poured. However, the carbides in chilled cast iron are surrounded by a soft material which limits the ability of the part to resist wear. In order to obtain improved wear resistance, the softer material surrounding the carbides must be hardened. If no alloying elements are present during a hardening process, the carbides revert to graphite and the matrix surrounding the carbides cannot be hardened in large sections. Although the composition described is suitable for use as a hardenable or chilled cast iron, the necessary alloying elements are specifically present for subsequent thermal treatment to improve wear resistance and permit higher contact stresses between mating parts. The present invention is specifically directed at a composition which not only has superior wear properties and will maintain its operative hardness at higher temperatures, but will maintain the highest amount of desired carbides after heat treatment to harden the matrix.

The tappet metallurgy disclosed in U.S. Pat. No. 3,370,941 has been found to be satisfactory in many respects for particular automotive applications, however, the presence of tungsten adds substantial cost to the tappet. The present invention eliminates tungsten, but yet provides a higher amount of carbides in a hardened matrix after heat treatment by increasing the amounts of chromium and molybdenum over those specified in the patented composition. In certain applications vanadium will be added.

Specifically, the novel material of the present invention is of the following composition:

| Element | Percent by Weight |
|---|---|
| Carbon | 3.20–3.70 |
| Silicon | 2.00–2.90 |
| Manganese | 0.60–1.00 |
| Chromium | 1.00–1.80 |
| Nickel | 0.40–0.70 |
| Molybdenum | 0.80–2.60 |
| Phosphorus | 0.40 Max. |
| Sulphur | 1.18 Max. |
| Copper | 0.15 |
| Iron | Balance |

It should be specifically noted that the amounts of chromium and molybdenum are increased over those specified in the U.S. Pat. No. 3,370,941 with the increased amounts of these two elements providing at least the same hardness for the matrix after the heat treating process as is obtained by the presence of tungsten in the '941 patent, and at substantially less cost. In addition, there are increased amounts of chromium in the carbides, a highly desirable result. In situations requiring increased wear resistance, vanadium is added to the above metallurgy in an amount of 0.10–0.50.

As specific examples of the novel composition, tappets formed with the following metallurgy have been tested:

EXAMPLE 1

| Element | Percent by Weight |
|---|---|
| Carbon | 3.52 |
| Silicon | 2.13 |
| Manganese | 0.89 |
| Chromium | 1.40 |
| Nickel | 0.60 |
| Molybdenum | 1.00 |
| Iron + other elements | Balance |

EXAMPLE 2

| Element | Percent by Weight |
|---|---|
| Carbon | 3.52 |
| Silicon | 2.53 |
| Manganese | 0.85 |
| Nickel | 0.60 |
| Chromium | 1.08 |
| Molybdenum | 2.27 |
| Vanadium | 0.20 |
| Iron + other elements | Balance |

EXAMPLE 3

| Element | Percent by Weight |
|---|---|
| Carbon | 3.59 |
| Silicon | 2.86 |
| Manganese | 0.85 |
| Nickel | 0.56 |
| Chromium | 1.48 |
| Molybdenum | 1.27 |

-continued

| Element | Percent by Weight |
|---|---|
| Vanadium | 0.20 |
| Iron + other elements. | Balance |

There are specific reasons for the amounts of the materials described in the above compositions. There must be sufficient carbon to allow the maximum amount of carbides to form in the chill area. Excessive carbon results in thin, unstable carbides with poor wear resistance. The amount of silicon must be closely controlled as an excessive amount of silicon can cause graphitization and loss of carbides in heat treatment. However, there must be sufficient silicon present to provide a sharp line of demarkation between the carbides and grairon to provide for machining of the tappet after it has been cast. Manganese and nickel are necessary to increase toughness and hardenability of the matrix during heat treatment. However, manganese and nickel have an adverse effect on carbide formation so the amount of manganese and nickel present in the composition must be properly controlled.

Chromium is a strong carbide former and thus increases chill depth and increases hardenability of the matrix. It tends to concentrate in the carbides and make the carbides more stable at heat treating temperatures.

Molybdenum is generally evenly distributed between the carbides and the surrounding matrix. It is a strong hardenability agent for the matrix. It tends to aid the formation of more desirable, coarser carbides when the material is cast.

Vanadium is a strong carbide former. The hard vanadium carbide adds to wear resistance. Excessive amounts of vanadium have an adverse effect on machinability as the carbides are formed in the areas away from the chill.

Of advantage in the described metallurgy is the adjustment of alloying elements to fit the size and operating loads of the tappet or camshaft. Unnecessarily high concentrations of alloying elements result in higher cost and more difficult machining. Of advantage in the described metallurgy is the fact that it can take a phosphate coating for break-in. Compositions with too great an alloy composition cannot be phosphate coated, which is known to be highly desirable, and at times necessary for breaking in engine components.

The tappet or camshaft described, after being poured upon a chilled plate or chill blocks, and subsequent cooling, may be heat treated by heating in a conventional furnace, molten salt, or by induction heating to a minimum temperature of 1580° F. up to 30 minutes and then quenched in liquid medium. The structure may thereafter be tempered at 350° F. or higher.

Whereas the preferred form of the invention has been shown and described herein, it should be realized that there may be many modifications, substitutions and alterations thereto.

The embodiments of the invention in which an exclusive property or privilege is claimed are defined as follows:

1. An internal combustion engine component comprising a body having at least a wearing surface formed of chilled high strength alloy cast iron consisting essentially of the following composition:

| Element | Percent by Weight |
|---|---|
| Carbon | 3.20–3.70 |
| Silicon | 2.00–2.90 |
| Manganese | 0.60–1.00 |
| Chromium | 1.00–1.80 |
| Nickel | 0.40–0.70 |
| Molybdenum | 0.80–2.60 |
| Iron (plus minor sulphur, copper & phosphorus elements) | Balance |

2. The structure of claim 1 including 0.10–0.50 percent by weight vanadium.

3. The structure of claim 1 wherein the maximum percentages of the sulphur, copper and phosphorus elements are respectively 0.18, 0.15 and 0.40.

4. The structure of claim 1 wherein said component is a tappet.

* * * * *